US005240345A

United States Patent [19]

Gagas

[11] Patent Number: 5,240,345

[45] Date of Patent: Aug. 31, 1993

[54] MANHOLE SEALING ASSEMBLY

[76] Inventor: Stanley Gagas, 3642 E. American Ave., Oak Creek, Wis. 53154

[21] Appl. No.: 790,597

[22] Filed: Nov. 7, 1991

[51] Int. Cl.[5] ..... E02D 29/14

[52] U.S. Cl. ..... 404/25; 52/20

[58] Field of Search ..... 404/2, 24, 25-26; 277/212 FB, 12, 212 R; 285/226; 52/20-21; 210/170

[56] References Cited

U.S. PATENT DOCUMENTS

| | | | |
|---|---|---|---|
| 4,345,772 | 8/1982 | Woody et al. | 277/212 FB |
| 4,387,903 | 6/1983 | Smith | 277/212 FB |
| 4,449,715 | 5/1984 | Gagas | 277/12 |
| 4,919,564 | 4/1990 | Neatherly et al. | 404/25 |
| 4,927,163 | 5/1990 | Gagas | 277/23 |
| 4,995,757 | 2/1991 | Prescott | 404/26 |
| 5,046,886 | 9/1991 | Muir et al. | 52/20 X |
| 5,062,735 | 11/1991 | Gaudin | 404/25 |
| 5,094,894 | 3/1992 | Schafferus et al. | 277/212 FB X |

*Primary Examiner*—Ramon S. Britts
*Assistant Examiner*—Nancy Connolly
*Attorney, Agent, or Firm*—Foley & Lardner

[57] ABSTRACT

An external manhole sealing assembly for sealing the joint to a manhole frame and a manhole casing which includes a resilient sleeve mounted on the manhole frame and the manhole casing to span the joint between the frame and casing, the sleeve is secured to a flexible ring which is mounted on the flange of the manhole frame and a second band encircling the sleeve on the manhole casing, the manhole frame being raised above the manhole casing a predetermined distance prior to sealing the sleeve to the manhole casing so that a bulge is created in the sleeve when the manhole frame is seated on the manhole casing, the bulge allowing for heaving of the manhole frame without destroying the joint seal.

5 Claims, 2 Drawing Sheets

MANHOLE SEALING ASSEMBLY

FIELD OF THE INVENTION

The present invention relates to a manhole seal and more particularly to a resilient seal assembly for sealing a manhole frame to the manhole casing.

BACKGROUND OF THE INVENTION

In U.S. Pat. No. 4,449,715 issued on May 22, 1984, and entitled "External Manhole Seal," and U.S. Pat. No. 4,927,163 issued on May 22, 1990, and entitled "Storm Infiltration Disk with Filter," seal assemblies are described for sealing the gap between the manhole and the manhole frame. In the '715 patent a compound was used to provide the seal between the manhole frame and the U-shaped circular band which is mounted on the flange of the manhole frame. Over time the sealing compound deteriorated, thus allowing water to seep into the gap and created upheavals in the frame. In the '163 patent, a filter was provided to allow water to seep through the seal but prevented sand or stones from entering the space between the frame and the disc. However, water which entered the space below the disc created a sufficient force to cause further upheavals of the frame. These upheavals allow foreign matter such as sand, soil and stones to accumulate in the gap between the disc and the manhole cover frame which eventually creates an opening that will allow water to flow into the manhole.

SUMMARY OF THE PRESENT INVENTION

The present invention relates to a manhole sealing assembly which includes a resilient seal ring and a resilient sleeve. The seal ring is mounted on the flange of the manhole frame. The resilient sleeve is mounted on the manhole casing. The seal ring is mounted on the flange of the manhole frame. The sleeve is mounted in the manhole casing. The manhole frame is then seated on the manhole casing and the sleeve is pulled upward around the seal ring and secured to the seal ring. The manhole frame is lifted off of the manhole casing a predetermined distance. The sleeve is secured to the manhole casing. The manhole frame is then seated on the casing producing a bulge in the sleeve which allows for heaving of the frame.

A principal feature of the invention is the provision of a fully sealed sleeve which prevents the accumulation of water in the space between the manhole frame and the manhole.

A further advantage of the invention is the elimination of any metallic discs thus providing a simple but leakproof seal for the manhole frame.

Other principal features and advantages of the invention will become apparent to those skilled in the art upon review of the following drawings, the detailed description and the appended claims.

Figure 1:
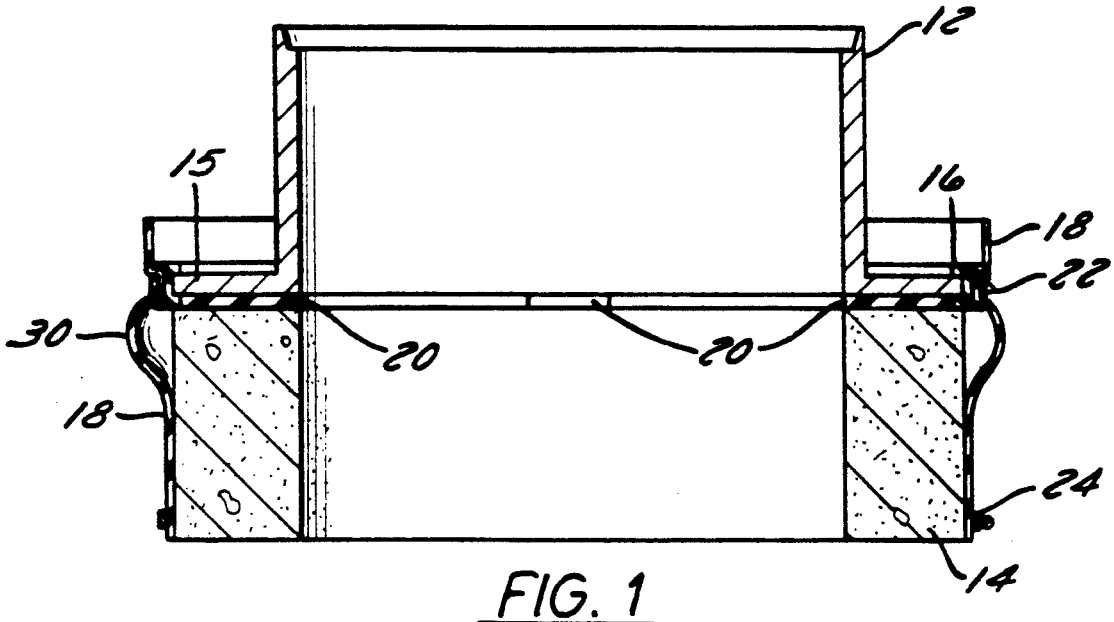
FIG. 1 is a cross section view of the manhole frame shown seated on the manhole casing.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The seal assembly 10 according to the present invention is used to seal the joint between a manhole frame 12 having a peripheral flange 15 and a manhole casing 14. The manhole frame 12 is generally placed directly on the top of the manhole casing 14 and then covered with back fill such as sand and gravel which may be topped with asphalt or cement. Over time the manhole frame will heave upward due to expansion and contraction of the surrounding fill as a result of the changes in temperature. Under such circumstances, the surrounding fill will seep through the joint into the manhole casing.

The seal assembly 10 according to the invention includes a resilient seal ring 16, a resilient sleeve 18, a number of resilient spacers 20 and a pair of screw type bands 22 and 24. The seal ring 16, sleeve 18 and spacers 20 are formed from a resilient material such as Wingprene, a product of Goodyear Canada, Inc., Special Products. The seal ring 16 includes an inner groove 26 and an outer groove 28. The seal ring 16 is mounted on the flange 15 of the manhole frame by aligning the groove 26 with the flange 15. The diameter of the inner wall 27 and the width of the groove 26 should be substantially the same as the outside diameter and width of the flange 15 to provide a tight fit.

The sleeve 14 has an inner diameter substantially equal to the outer diameter of the manhole casing 14. The sleeve 14 has a length sufficient to overlap the edge of the flange 15 on the manhole frame with a substantial portion of the sleeve covering the upper end of the manhole casing. The sleeve 14 is attached or secured to the seal ring 16 on the flange 15 by means of the screw type band 22 which is aligned with the groove 28 and drawn up tight to seal the sleeve in the groove 28 and the ring to the flange 15.

The seal assembly 10 is mounted on the manhole frame 12 and manhole casing 14 by initially mounting the sleeve 18 on the upper end of the manhole casing 14. The spacers 20 are positioned on the top of the manhole at equally spaced intervals with the inner edge aligned with the inside diameter of the manhole casing.

Figure 5:
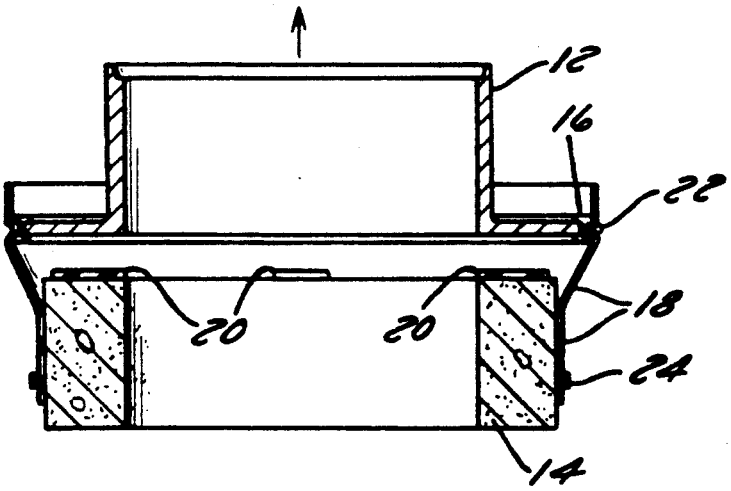
FIG. 5 is a view of the sleeve spanning the space between the manhole frame and the manhole casing.
Figure 2:
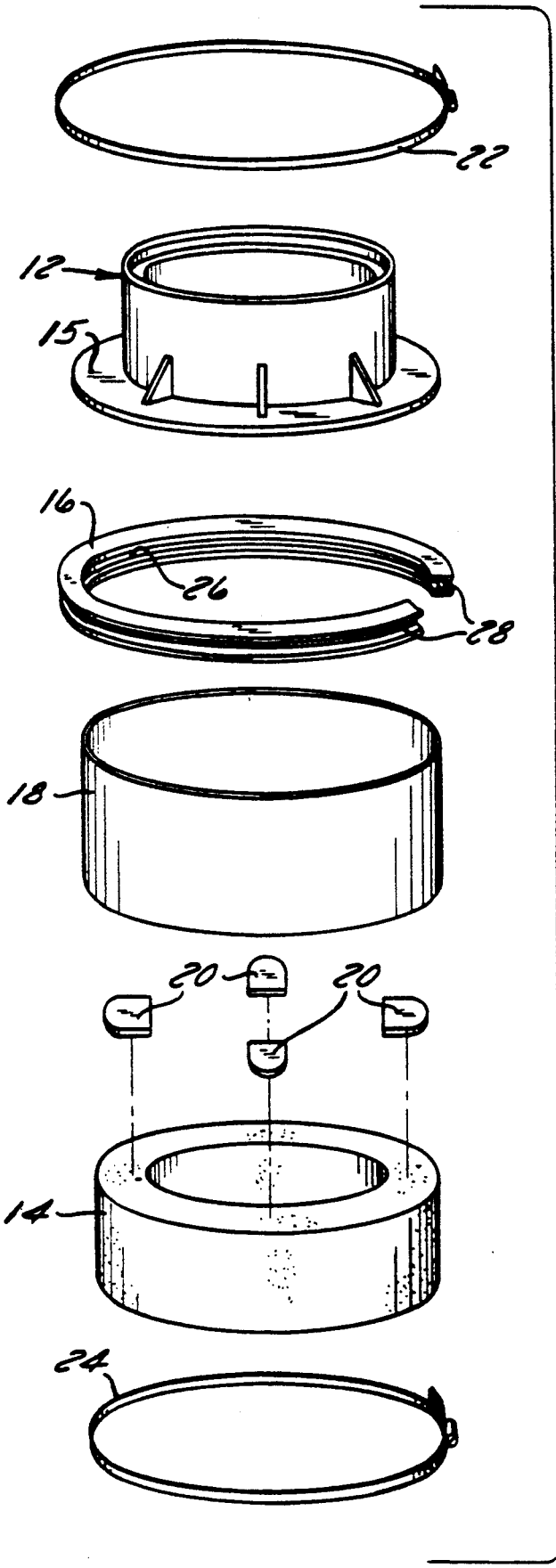
FIG. 2 is an exploded, perspective view of the seal assembly, manhole frame and manhole casing.
Figure 3:
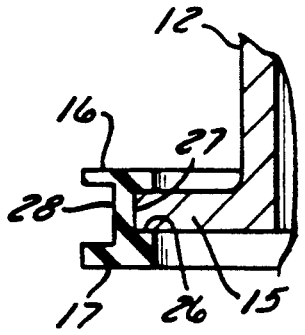
FIG. 3 is a partial sectional view showing the resilient seal ring mounted on the flange of the manhole frame.
Figure 4:
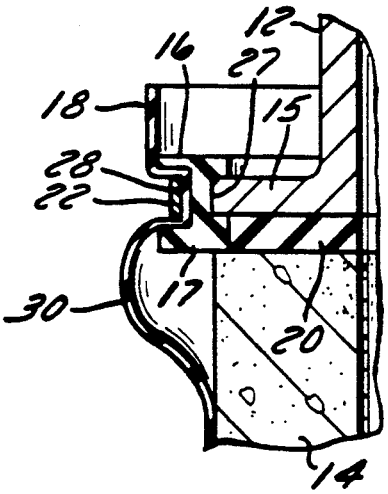
FIG. 4 is a partial view in section showing bulge in the resilient sleeve when the manhole frame is seated on the manhole casing.

The ring 16 is mounted on the frame 12 by aligning the flange 15 in the groove 26 in the ring. The manhole frame 12 is then seated on the top of the manhole casing 14. The lower inner flange 17 of the ring 16 should be seated on the manhole in the space between the adaptors 20 and the outer diameter of the manhole. The flange 17 is thereby protected from the full weight of the manhole frame 12 by the spacers 20. The sleeve 18 is pulled up over the ring 16 on the flange 15. The band 22 is mounted on the sleeve 18 and aligned with the groove 28 in the ring. The band 22 is then tightened to seat the sleeve in the groove 28 in ring 16 and the ring 16 to the flange 15. The manhole frame 12 is then lifted off of the manhole casing 14 to pull the sleeve 18 upward a short distance, two to four inches, as shown in FIG. 5. The band 24 is then attached to the lower end of the sleeve 18 and drawn up tight to seal the sleeve 18 to the outside surface of the manhole casing 14. The manhole frame 12 is then seated on the spacers 20 on the top of the manhole casing 14 producing a bulge 30 in the sleeve around the joint between the frame and the manhole casing. In the event of any heaving of the manhole frame, the bulge 30 will allow for limited movement of the manhole frame 12 without rupturing the sleeve 18.

Thus, it should be apparent that there has been provided in accordance with the present invention a manhole sealing assembly that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An external manhole sealing assembly for sealing the joint between the peripheral flange on a manhole frame and the periphery of a manhole casing, said assembly comprising:

a resilient ring positioned on the periphery of the flange on the manhole frame;

a resilient sleeve spanning the joint between the periphery of the flange of the manhole frame and the periphery of the manhole casing;

a first band for securing said ring and said sleeve to the periphery of the flange and a second band for securing the lower end of said sleeve to the periphery of the manhole casing, the length of the sleeve between said bands being greater than the distance between said bands to provide a bulge in said sleeve when the frame is seated on the manhole casing.

2. The assembly according to claim 1 wherein said flexible ring includes an inner groove to matingly engage the periphery of the flange on the frame and an outer groove, said first band being mounted on said sleeve in alignment with said outer groove in said ring.

3. The assembly according to claim 2 including a number of resilient spacers mounted on the top of said manhole casing to provide a space between the manhole casing and the flange for said resilient ring.

4. A method for sealing the joint between the peripheral flange on the top of a manhole casing and the bottom of a peripheral flange on a manhole frame, said method including the steps of mounting a resilient sleeve on the upper end of the manhole casing, placing a resilient seal ring on the periphery of the flange on the manhole frame;

placing the manhole frame on the top of the manhole casing, pulling the sleeve upward to enclose the periphery of the flange on the manhole frame, securing the sleeve to the periphery of the flange on the manhole frame, raising the frame above the manhole casing to pull the sleeve upwardly from the manhole casing, securing the sleeve to the manhole casing and replacing the manhole frame on the manhole whereby an expansion bulge is provided in the sleeve to seal the joint.

5. The method according to claim 4 including the step of placing resilient spacers on the top of the manhole casing prior to placing the manhole frame on the manhole casing.

* * * * *